US011208842B2

(12) United States Patent
Kwon

(10) Patent No.: US 11,208,842 B2
(45) Date of Patent: Dec. 28, 2021

(54) MULTIFUNCTIONAL DUAL ROLL BLIND HAVING ROLL SCREEN AND ROLL SCREEN USED THEREFORE

(71) Applicant: ZEITGEBER, INC., Seoul (KR)

(72) Inventor: Youngtaek Kwon, Seoul (KR)

(73) Assignee: ZEITGEBER, INC., Seoul (KR)

( * ) Notice: Subject to any disclaimer, the term of this patent is extended or adjusted under 35 U.S.C. 154(b) by 63 days.

(21) Appl. No.: 15/552,513

(22) PCT Filed: Mar. 10, 2015

(86) PCT No.: PCT/KR2015/002315

§ 371 (c)(1),
(2) Date: Aug. 22, 2017

(87) PCT Pub. No.: WO2016/137045

PCT Pub. Date: Sep. 1, 2016

(65) Prior Publication Data

US 2018/0030782 A1 Feb. 1, 2018

(30) Foreign Application Priority Data

Feb. 26, 2015 (KR) ..... 10-2015-0027534

(51) Int. Cl.
*E06B 9/42* (2006.01)
*E06B 9/78* (2006.01)
*E06B 9/24* (2006.01)

(52) U.S. Cl.
CPC ..... *E06B 9/42* (2013.01); *E06B 9/78* (2013.01); *E06B 2009/2405* (2013.01)

(58) Field of Classification Search
CPC ... E06B 9/264; E06B 9/42; E06B 9/78; E06B 2009/2405; E06B 9/24; E06B 9/40
See application file for complete search history.

(56) References Cited

U.S. PATENT DOCUMENTS 2,384,377 A * 9/1945 Holstein ..... E06B 9/40 160/85
3,444,919 A * 5/1969 Karoll ..... E06B 9/24 160/184

(Continued)

FOREIGN PATENT DOCUMENTS

JP 2009079431 A * 4/2009
KR 10-2011-0009062 A 1/2011
KR 20-2013-0006983 U 12/2013

*Primary Examiner* — Daniel P Cahn
(74) *Attorney, Agent, or Firm* — Sughrue Mion, PLLC

(57) ABSTRACT

A multifunctional double roll blind includes a roll screen, a housing, a winding rod and a twist preventing member in which the roll screen includes first and third adjustment units and a second adjustment unit formed between the first adjustment unit and the third adjustment unit, the first adjustment unit includes first translucent mesh parts and first blocking parts arranged in an alternating pattern, the third adjustment unit includes third translucent mesh parts and third blocking parts arranged in an alternating pattern, the second adjustment unit includes second translucent mesh parts and second blocking parts arranged in an alternating pattern, and the roll screen is configured to be in one of (i) a fully opening mode, (ii) a fully closed mode and (iii) an opening mode at an upper section and an closed mode at a lower section according to rotation of the winding rod.

4 Claims, 10 Drawing Sheets

(56) References Cited

U.S. PATENT DOCUMENTS 6,189,592 B1 * 2/2001 Domel ..... E06B 9/24 160/241
7,174,940 B2 * 2/2007 Nien ..... E06B 9/42 160/120
9,631,422 B1 * 4/2017 Chen ..... E06B 9/42
9,890,583 B2 * 2/2018 Marocco ..... E06B 9/78
10,060,184 B2 * 8/2018 Chu ..... E06B 9/388
2005/0051282 A1 * 3/2005 Bohlen ..... E06B 9/24 160/238
2006/0021713 A1 * 2/2006 Hsu ..... E06B 9/40 160/85
2006/0027339 A1 * 2/2006 Hsu ..... E06B 9/40 160/120
2007/0084568 A1 * 4/2007 Nien ..... A47H 23/06 160/85
2009/0139173 A1 * 6/2009 Wilkins ..... E06B 7/08 52/473
2009/0229768 A1 * 9/2009 Cheng ..... A47H 23/06 160/237
2010/0258255 A1 * 10/2010 Lee ..... E06B 9/42 160/319
2012/0043029 A1 * 2/2012 Gaskill ..... E06B 9/42 160/121.1
2012/0291965 A1 * 11/2012 Marocco ..... E06B 9/40 160/120
2015/0083350 A1 * 3/2015 Blair ..... E06B 9/44 160/291
2015/0233179 A1 * 8/2015 Huang ..... E06B 9/40 160/309
2016/0130863 A1 * 5/2016 Cheng ..... E06B 9/40 160/179
2016/0145937 A1 * 5/2016 Chu ..... E06B 9/24 160/86
2016/0319591 A1 * 11/2016 Cheng ..... E06B 9/40
2016/0348428 A1 * 12/2016 Cheng ..... E06B 9/40
2017/0009519 A1 * 1/2017 Marocco ..... E06B 9/44
2017/0145738 A1 * 5/2017 Marocco ..... E06B 9/264
2017/0211323 A1 * 7/2017 Chen ..... E06B 9/34
2017/0362892 A1 * 12/2017 Marzilli ..... E06B 9/72
2018/0119486 A1 * 5/2018 Kanno ..... E06B 5/00
2018/0298684 A1 * 10/2018 Siebenaller ..... E06B 9/386
2018/0340369 A1 * 11/2018 Goldberg ..... E06B 9/44

* cited by examiner

MULTIFUNCTIONAL DUAL ROLL BLIND HAVING ROLL SCREEN AND ROLL SCREEN USED THEREFORE

BACKGROUND OF THE INVENTION

1. Field of the Invention

The present invention relates to a multifunctional double roll blind having a roll screen and a roll screen used therefor. More particularly, the multifunctional double roll blind having a roll screen and a roll screen used therefor is divided into an upper side and a lower side, which can be independently opened and closed by a single double roll blind manipulation. Thereby, the variously implementing opening and closing of the blind is operated in response to user's choice.

2. Description of the Related Art

In general, the curtains and blinds are installed at the windows or entrance of a building to purposely use for blocking the light, blocking the outside sight, preventing the noise, and preventing the cold. In addition to this practicality, the curtains and blinds are used as an important element of the interior decoration for improving the aesthetics of the interior according to a blend of colors which may be harmonized with an inner wall or glass.

The blinds include a vertical blind, a venetian blind, a roman shade, a roll blind, a double roll blind, and the like.

Among the blinds, the double roll blind has a form in which the fabric is rolled up by winding the roll of the upper housing, and recently, a fabric in which portions having a mesh structure (the objects on the opposite side are visible) and portions having a light-blocking structure (the objects on the opposite side are not visible) are repeatedly formed with predetermined widths has been configured and released.

That is, the double roll blind adjusts the light-blocking degree according to the degree of overlapping the front fabric and the rear fabric, and for example, has a structure in which light is maximally emitted when the front mesh structure and the rear mesh structure are matched (aligned in parallel) with each other, and has a structure in which the light is entirely blocked when the front light-blocking structure and the rear light-blocking structure are mismatched with each other, thereby adjusting the light-blocking degree and fully introducing the light by entirely rolling up the fabric of the double roll blind.

The fabric to be applied to such a double roll blind is fabricated by weaving through a weaving machine, mainly fabricated by a weaving machine equipped with a warp beam of which warps are wound at regular intervals, and the wefts of the mesh portion are coarsely supplied and crossed in a vertical direction in a wrap direction to have a net structure to be transparently transmitted, and the light-blocking structure portion configures the light blocking structure in which the wefts are densely supplied and crossed in a direction perpendicular to the warp direction.

In recent years, as illustrated in FIG. 1, a double roll blind capable of adjusting a light amount and a viewing angle partially transmitted by a roll screen formed by alternately forming transparent portions and sight and light blocking part has been developed. Further, portions through which the objects on the opposite side are visible are formed by translucent mesh part 241*a*, and portions through which the objects on the opposite side are not visible are formed by sight and light blocking part 241*b*.

However, in the double roll blind according to the first related art as described above, when the screen is almost deployed, while the upper portion implements the sight or transmission of light by user's manipulation, only the lower portion may not block the light, and thus, there is a problem in that the demands of the user are not satisfied.

Meanwhile, as the second related art for solving the above problems, there are Korean Patent Application Publication No. 10-2011-0009062 (screen for roll blind and multifunctional double roll blind having roll screen) and Korean Utility Model Publication No. 20-2013-0006983 (multifunctional double roll blind having roll screen) which are developed by the present inventors.

The second related art is to provide a multifunctional double roll blind having a roll screen in which a window is divided into the upper portion and the lower portion to entirely light-blocking the screen or selectively light-blocking only the lower portion by user's manipulation, thereby satisfying user's demands.

In the accompanying drawings, FIG. 2 is a perspective view illustrating a use state of a multifunctional double roll blind having a roll screen according to the second related art and FIG. 3A is a partially cross-sectional view illustrating drivers of the multifunctional double roll blind having a roll screen according to the second related art and the present invention.

As illustrated in FIGS. 2 and 3A, a multifunctional double roll blind 200 having a roll screen according to the second related art includes a housing 210 which is fixed to a ceiling with a window or a wall surface through a fixing bracket (not illustrated) and provided so that a lower surface is opened, a winding rod 230 of which one end is rotatably connected to both sides of the housing 210 and the other end is rotatably installed via an ascending/descending means 220 to be rotatably provided so as to operate the ascending/descending means 220 in winding and unwinding directions, and a roll screen 240 in which one end of the roll screen 240 is fixed and wound on the winding rod 230, and the other end of the roll screen 240 is fixed to the housing 210 to be unwound and wound by rotating the winding rod 230, thereby blocking the outside partially or entirely so as to cover the whole or only the lower portion of light or prevent the whole or only the lower portion of the inside of the interior from being viewed from the outside and enabling ventilation.

Herein, on the roll screen 240, a twist preventing member 250 is provided, in which the roll screen 240 is unwound and wound without twist by maintaining tension when the roll screen 240 is unwound from and wound on the winding rod 230 by rotating the winding rod 230 by manipulation of the ascending/descending means 220.

In more detail, the housing 210 is configured by a horizontal plate 210*a* which is fixed to the ceiling or wall surface of the window through a fixing bracket, a cover plate 210*b* which is extending downward from the front end of the horizontal plate 210*a* to cover the roll screen 240 wound on the winding rod 230, a fixing piece 210*c* which is bent and extended upward and downward from the rear end of the horizontal plate 210*a* to fix the other end of the roll screen 240 fixed and wound on one end to the winding rod 230, and left and right fixing members of which one end is fixed to both ends of the horizontal plate 210*a* through a screw and a lower end is integrally formed with a bent piece (not illustrated) bent inward so that the ascending/descending means 220 is installable to rotate the winding rod 230 by user's manipulation by connecting one end of the winding rod 230 and the other end of the winding rod 230. In FIG. 2, the right fixing member is indicated as reference numeral 210*e*.

The ascending/descending means 220 is a conventional general well-known technique which is installed on the inner surface of the right fixing member 210*e* to rotate the winding rod 230 according to the user's manipulation, and the description thereof will be briefly described as follows.

That is, the ascending/descending means 220 is configured by an ascending fixing piece 220*a* which is fixably provided by penetrating the bent piece of the right fixing member 210*e* to the center so as to be installed in the inside of the right surface of the housing 210, an ascending rotation piece 220*b* of which one end is rotatably provided at the ascending fixing piece 220*a* and locking holes (not illustrated) are formed in a circumferential direction at regular intervals on the outer circumferential surface, and an ascending/descending driving rope 220*c* which winds the outer circumferential surface of the ascending rotation piece 220*b* to rotate the ascending rotation piece 220*b* in response to user pulling in one direction and the other direction.

The winding rod 230 is formed to have a circular section, and one end of the winding rod 230 is rotatably connected to a bent piece (not illustrated) of the left fixing member of the housing 210 through a hinge piece (not illustrated) and the other end of the winding rod 230 is fixed and connected to the ascending rotation piece 220*b* of the ascending/descending means 220, and a cutting groove 230*a* for inserting and fixing one end of the roll screen 240 is cut in a longitudinal direction on the outer circumferential surface.

The roll screen 240 is configured by a blocking portion 242 and adjustment units 241 in which mesh parts 241*a* through which objects on the opposite side are visible and light-blocking parts 241*b* through which objects on the opposite side are not visible are alternately repeated at a predetermined range with a predetermined width and the adjustment units 241 are formed at the upper portion and the lower portion with respect to the entire length, and the blocking portion 242 is formed between the adjustment units to block the outside. The adjustment units 241 of the roll screen 240 formed at the upper portion and the lower portion are wound on the twist preventing member 250 to entirely block the light or block only the lower portion by partially or entirely blocking the outside in response to operating the ascending/descending means 220 in unwinding and winding directions as illustrated in FIGS. 2 and 3A, thereby preventing the inside of the interior from being seen from the outside from the whole or middle portion to the lower portion. Accordingly, the lengths of the adjustment units 241 formed at the upper portion and the lower portion of the entire length are the same as each other with each of the lengths being about ¼ of the entire length, and the blocking portion 242 is formed in a section of about ¾ of the entire length obtained by subtracting the lengths of the adjustment units 241 formed at the upper portion and the lower portion from the entire length.

That is, the adjustment units 241 of the roll screen 240 are formed at a section of about ¼ of the lengths of the upper portion and the lower portion with respect to the entire length and the blocking portion 242 is formed in a section of about ¾ with respect to the entire length.

In more detail, the roll screen 240 is configured by a first adjustment unit formed at the start portion in the entire length direction, a second adjustment unit formed at the end portion, and a blocking portion 242 formed between the first adjustment unit and the second adjustment unit to block the outside. The first adjustment unit and the second adjustment unit of the roll screen 240 formed at the start portion and the end portion are wound on the twist preventing member 250 to entirely block the light or block only the lower portion by partially or entirely blocking the outside in response to operating the ascending/descending means 220 in unwinding and winding directions or preventing the inside of the interior from being seen from the outside from the whole or middle portion to the lower portion. Accordingly, the lengths of the first adjustment unit and the second adjustment unit formed at the start portion and the end portion of the entire length are the same as each other with each of the lengths of the first adjustment unit and the second adjustment unit being about ¼ of the entire length, and the blocking portion 242 is formed in a section of about ¾ of the entire length obtained by subtracting the lengths of the first adjustment unit and the second adjustment unit formed at the start portion and the end portion from the entire length.

Meanwhile, the blocking portion 242 is integrally formed by weaving the adjustment units 241 as described above, but is not limited thereto, and the blocking portion 242 is woven to correspond to the width of the woven roll screen so that the both ends thereof are fixed to the screen in which the translucent mesh part and the sight and light blocking part are alternately woven through a fixing means or fusion or sewing.

After the multifunctional double roll blind having the roll screen according to the second related art configured as such is fixed to the ceiling of the window, when the roll screen 240 of the roll blind 200 intends to be adjusted to block the light or prevent the inside of the interior from being seen from the outside and enable ventilation, as illustrated in FIG. 2 of the accompanying drawings, first, the user grips the ascending/descending driving rope 220*c* of the ascending/descending means 220 and pulls the driving rope 220*c* downward.

When the ascending/descending driving rope 220*c* is pulled downward, the ascending rotation piece 220*b* of the ascending/descending means 220 is rotated, and as a result, the winding rod 230 having one end and the other end rotatably mounted on the housing 210 and the ascending/descending rotation piece 220*b* is rotated in one direction, that is, in a direction in which the roll screen 240 wound on the winding rod 230 is unwound.

The roll screen 240 is tensioned downward by the self-weight of the twist preventing member 250 in response to the rotation of the winding rod 240 and unwound without twist.

As such, by using the roll screen 240 wound on the winding rod 230 while the roll screen 240 is unwound from the winding rod 230, when the upper portion of the window may be provided to see light, outer air, and the outside and the lower portion is blocked not to see the outside, the user gripes the ascending/descending driving rope 220*c* and pulls the driving rope 220*c* downward, and thus, the blocking portion 242 of the wound roll screen 240 is positioned at the lower portion of the roll screen 240, and then as illustrated in FIG. 2, the upper portion of the window can see the light, outer air, and the outside and the lower portion is blocked not to see the outside.

Further, when the user gripes the ascending/descending driving rope 220*c* and pulls the driving rope 220*c* downward, the adjustment units 241 and the blocking portion 242 may block the entire window.

That is, when the roll screen 240 is fully wound, the window is fully opened, when the roll screen 240 is unwound only by ¼ or less, the light-blocking degree of only a part of the upper portion is adjusted and the rest is fully opened according to the degree of overlapping of the translucent mesh part and the sight and light blocking part of the first adjustment unit at the start portion. In addition, when the roll screen 240 is unwound by ¼ or more, the light-blocking degree is entirely adjusted according to the degree of overlapping of the translucent mesh part and the sight and light blocking part of the first adjustment unit at the start portion and the sight and light blocking part, and when the roll screen 240 is almost unwound, the middle portion to the lower portion are blocked by the light-blocking portion or the light-blocking degree from the middle portion to the upper portion is adjusted according to the degree of overlapping of the first adjustment unit at the start portion and the second adjustment unit at the end portion.

As such, the multifunctional dual roll blind having the roll screen of the second related art can use the roll screen as desired by user's manipulation, thereby satisfying the user's demands.

However, in the multifunctional double roll blind having the roll screen according to the second related art, there is one limitation, and it is common to block the lower portion in the interior and adjust lighting of the upper portion, but when only the lower portion is desired to be partially opened (for example, if the user wants to look outside while sitting on a chair), there is no way to deal with the case.

SUMMARY OF THE INVENTION

The present invention has invented in an effort to provide a multifunctional dual roll bind having a roll screen and a roll screen used therefor, in which the screen is divided into upper and lower portions such that the entire screen can be blocked the light by the user's manipulation or the upper portion can solely be opened/adjusted while only the lower portion is selectively blocked the light, and the upper and lower portions can be partially opened at the same time, thereby further satisfying the user's demands.

An aspect of the present invention provides a multifunctional double roll blind having a roll screen including: a housing (310) fixed to a ceiling including a window or a wall surface; a winding rod (330) rotatably provided by an ascending/descending means (320) in the housing (310); a roll screen (340), of which one end is fixed to the winding rod (330) and the other end is fixed to the housing (310) for winding or unwinding by rotating the winding rod (330); a twist preventing member (350) is for un-twisting the roll screen (340) by tensioning the roll screen (340) when the winding rod (330) is rotating for winding or unwinding manipulation by the ascending or descending means (320); the roll screen (340) is configured by a first adjustment unit (341) formed at a starting part, a third adjustment unit (343) formed at an ending part, a second adjustment unit (342) formed between the first adjustment unit (341) and the third adjustment unit (343); the first adjustment unit (341) has a plurality of first translucent mesh part (341*a*) and a plurality of first sight and light blocking parts (341*b*) arranged in an alternating pattern with a predetermined range and width; the third adjustment unit (343) has a plurality of third translucent mesh part (343*a*) and a plurality of third sight and light blocking parts (343*b*) arranged in an alternating pattern with a predetermined range and width; the second adjustment unit (342) has a plurality of second translucent mesh parts (342*a*) and a plurality of second sight and light blocking parts (342*b*) arranged in an alternating pattern with a predetermined range and width; the first translucent mesh part (341*a*), the second translucent mesh part (342*a*) and the third translucent mesh part (343*a*) have the same width (a); the first sight and light blocking part (341*b*) and the third sight and light blocking part (343*b*) have the same width (b); the first sight and light blocking part (341*b*) has the width (b) of one to five cm larger than the width (a) of the first translucent mesh part (341*a*); the width (c) of the second sight and light blocking part (342*b*) has a width (c=a+2b) obtained by adding the width (a) of the first translucent mesh part (341*a*) to the twice of the width (b) of the first sight and light blocking part (341*b*); each of the length of the first adjustment unit (341) and the length of the third adjustment unit (343) is one-sixth (⅙) or more of the entire length of the roll screen and one-third (⅓) or less of the entire length of the roll screen, the plurality of first sight and light blocking parts (341*b*) consist of at least four sets; one first translucent mesh part is inserted between the plurality of first sight and light blocking parts; that is, one first translucent mesh part and one first sight and light blocking part are alternately arranged at the starting part, which is one ending part of the entire screen; the plurality of third sight and light blocking parts (343*b*) has same number of the first sight and light blocking parts; one third translucent mesh part is inserted between the plurality of third sight and light blocking parts; that is, one third translucent mesh part and one third sight and light blocking part are alternately arranged at the end part, which is the other ending part of the entire screen; the plurality of second sight and light blocking parts (341*b*) is consisted of at least even number of four set; one second translucent mesh part is inserted between the plurality of second sight and light blocking parts; that is, one second translucent mesh part and one second sight and light blocking part are alternately arranged at the center of the entire screen; and one translucent mesh part is inserted between the first sight and light blocking part (341*b*) and the second sight and light blocking part (342*b*) located at the boundary of the first adjustment unit and the second adjustment unit; and one translucent mesh part is also inserted between the third sight and light blocking part (343*b*) and the second sight and light blocking part (342*b*) located at the boundary of the third adjustment unit and the second adjustment unit. (a) when the roll screen is fully deployed or almost deployed, the roll screen will be symmetry in both front and rear portions; when the front translucent mesh part is matched to the rear translucent mesh part in both upper and lower portions, the roll screen will be an open mode in both upper and lower portions; (b) in the previous state (a), the rear translucent mesh part matches to the front sight and light blocking part, while the front translucent mesh part is matching to the rear sight and light blocking part, the roll screen will be a blocking mode in both upper and lower portions depending on the winding or unwinding of the ascending/descending driving rope; (c) in the previous state (b), the front and rear translucent mesh parts are matched each other in the upper portion, while the front translucent mesh part is matched to the rear sight and light blocking part in the lower portion; then, the roll screen will be the open mode in the upper portion and the blocking mode in the lower portion depending on the winding or unwinding of the ascending/descending driving rope; and the roll screen is possibly set to an intermediate mode between the state (a) and state (b), and the intermediate mode between the state (b) and the state (c).

Preferably, a width (c) of the second light blocking part 342*b* has a width (c=a+2b) obtained by adding a width a of the first mesh part 341*a* to the twice of a width (b) of the first light blocking part 341*b*.

Further, preferably, the width b of the first light blocking part 341*b* may be 2 to 5 cm larger than the width a of the first mesh part 341*a*.

More preferably, the width b of the first light blocking part 341*b* may be 2.5 to 4 cm larger than the width a of the first mesh part 341*a*.

Further, preferably, each of lengths of the first adjustment unit 341 and the third adjustment unit 343 may be ⅙ or more and ⅓ or less of the entire length of the roll screen, respectively.

Another exemplary embodiment of the present invention provides a roll screen used in a multifunctional double roll blind including: a first adjustment unit 341 formed at a start portion, a third adjustment unit 343 formed at an end portion, and a second adjustment unit 342 formed between the first adjustment unit 341 and the third adjustment unit 343, in which the first adjustment unit 341 has first translucent mesh part 341*a* and first sight and light blocking part 341*b* alternately formed with a predetermined range and width; the third adjustment unit 343 has third translucent mesh part 343*a*, and third sight and light blocking part 343*b* alternately formed with a predetermined range and width; the second adjustment unit 342 has second translucent mesh part 342*a* and second sight and light blocking part 342*b* alternately formed with a predetermined range and width; the first mesh part 341*a*, the second mesh part 342 *a*, and the third mesh part 343*a* have same width; the width of the first light blocking part 341*b* and the third light blocking part 343*b* are same; width c of the second light blocking part 342*b* has a width (c=a+2b) obtained by adding a width (a) of the first mesh part 341*a* to the twice of width (b) of the first light blocking part 341*b*, and each of lengths of the first adjustment unit 341 and the third adjustment unit 343 is ⅙ or more and ⅓ or less of the entire length of the roll screen, respectively.

Preferably, the roll screen is integrally woven and the translucent mesh part is made of air permeable material.

As described above, according to the multifunctional double roll blind having the roll screen and the roll screen used therefor of the present invention, the screen is divided into the upper and lower portions, so that the entire screen can block the light by the user's manipulation or the upper portion is independently opened/adjusted while the lower portion is blocking the light, and it is also possible to open the upper and lower portions partially, at the same time to satisfy the user's demands.

DETAILED DESCRIPTION OF THE PREFERRED EMBODIMENTS

Figure 1:
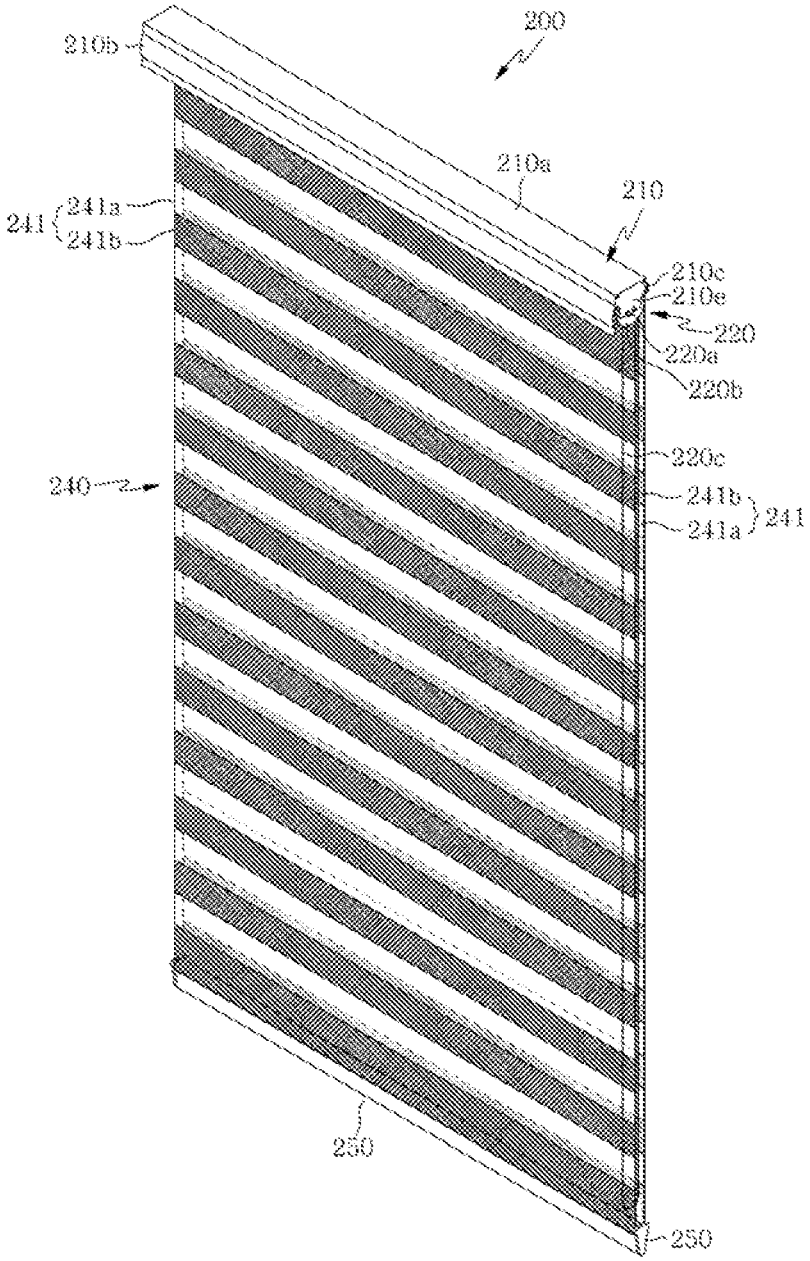
Fig. 1 (prior art)
FIG. 1 is a perspective view illustrating a use state of a multifunctional double roll blind having a roll screen according to the first related art.

Hereinafter, an exemplary embodiment of a multifunction double roll blind having a roll screen and a roll screen used therefor according to the present invention will be described with reference to FIGS. 3B to 6 in detail.

First, it should be noted that the same elements or components in the drawings will be designated by the same reference numerals. In describing the present invention, a detailed description of publicly known functions or configurations incorporated herein will be omitted so as not to make the subject matter of the present invention unclear.

Figure 4:
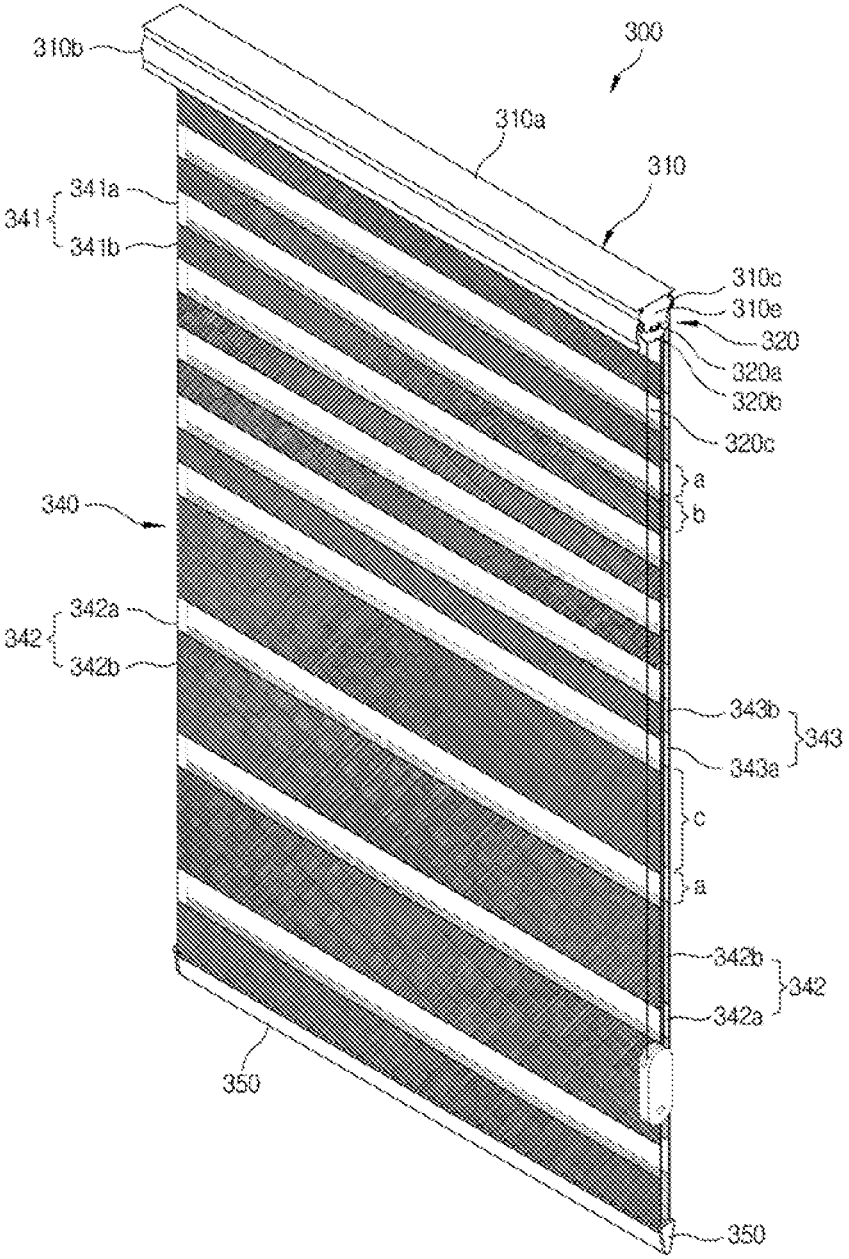
FIG. 4 is a perspective view illustrating a use state of a multifunctional double roll blind having a roll screen according to the present invention.
Figure 5:
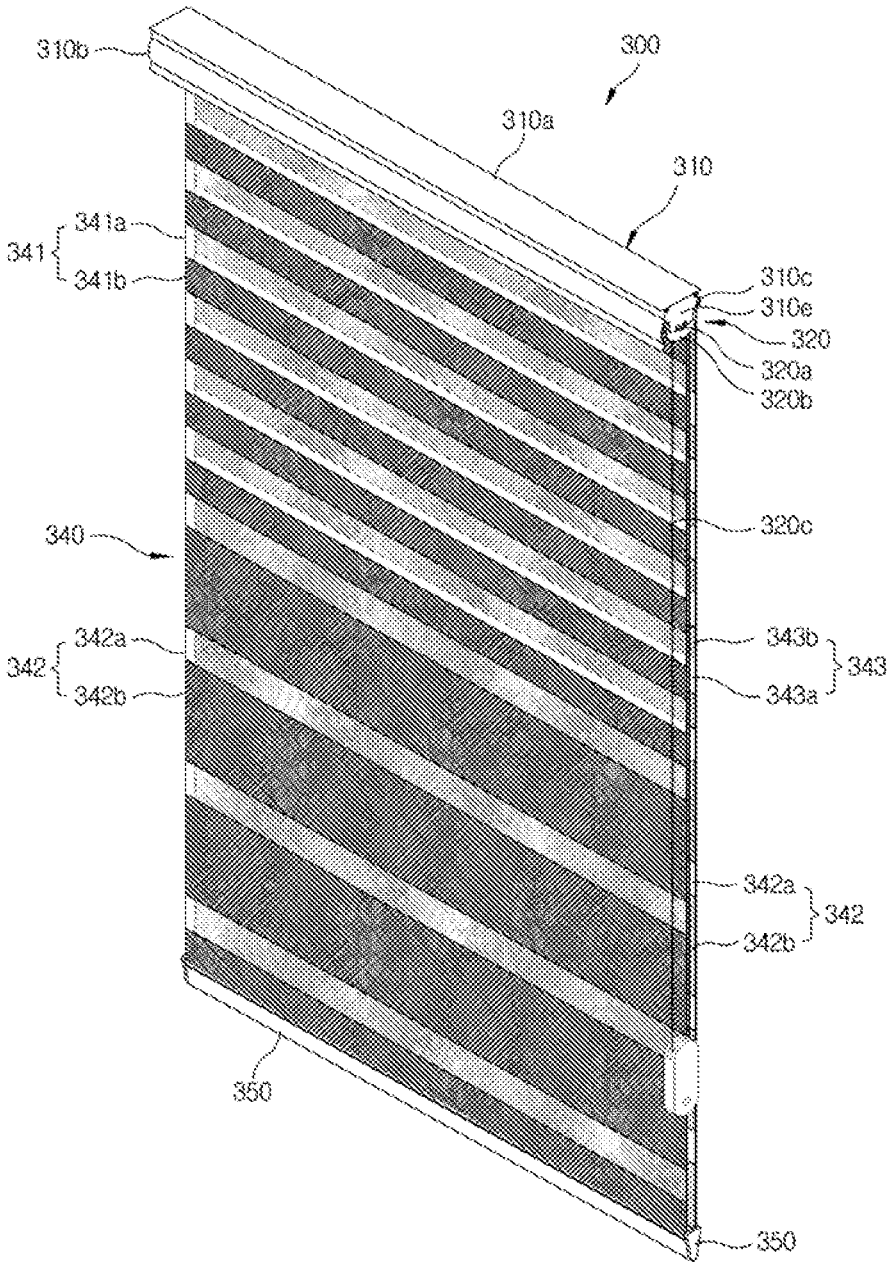
FIG. 5 is a perspective view illustrating another use state of the multifunctional double roll blind having a roll screen according to the present invention.
Figure 6:
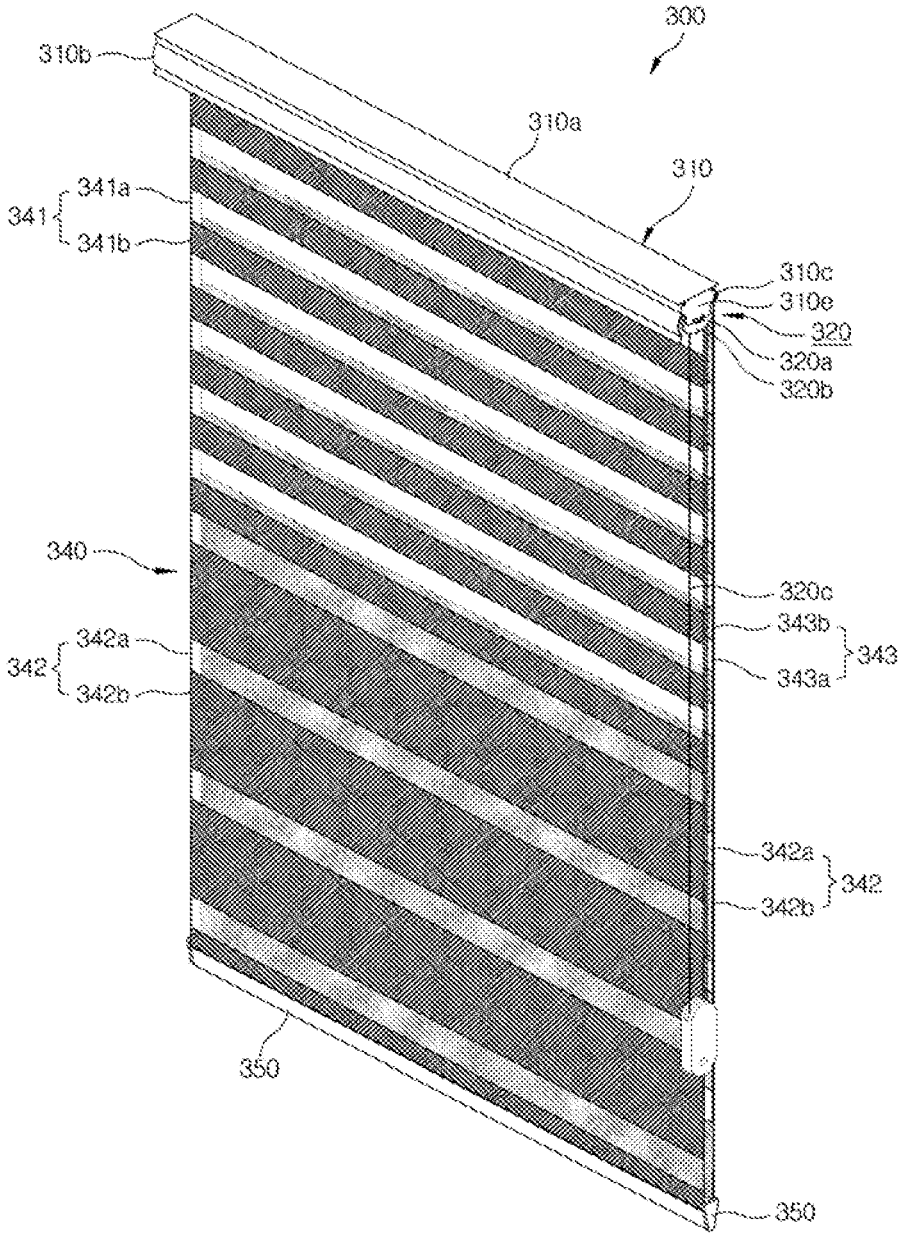
FIG. 6 is a perspective view illustrating yet another use state of the multifunctional double roll blind having a roll screen according to the present invention.

In the accompanying drawings, FIGS. 3B to 6 are perspective views illustrating use states of a multifunction double roll blind having a roll screen according to the present invention, FIG. 4 is a perspective view illustrating a use state in which the entire screen is partially opened, FIG. 5 is a perspective view illustrating a use state in which the entire screen is closed, and FIG. 6 is a perspective view illustrating a use state in which an upper portion is partially opened and a lower portion is closed.

In order to simplify the description and clarify the difference from the second related art, in FIGS. 3B to 6 of the accompanying drawings, parts having similar functions to those of the double roll screen according to the second related art are designated like reference numerals and the detailed description thereof will be omitted or briefly described.

As illustrated in FIGS. 3B to 6, a multifunctional double roll blind 300 having a roll screen according to the present invention includes a housing 310 which is fixed to a ceiling with a window or a wall surface through a fixing bracket (not illustrated) and provided so that a lower surface is opened, a winding rod 330 in which one end of the winding rod 330 is rotatably connected to both sides of the housing 310 and the other end of the winding rod 330 is rotatably installed via an ascending/descending means 320 to be rotatably provided so as to operate the ascending/descending means 320 in winding and unwinding directions, and a roll screen 340 in which one end of the roll screen 340 is fixed and wound on the winding rod 330, and the other end of the roll screen 340 is fixed to the housing 310 to be wound and unwound by rotating the winding rod 330, thereby blocking the outside partially or entirely so as to cover the whole or only the lower portion of light or prevent the whole or only the lower portion of the inside of the interior from being viewed from the outside and enabling ventilation.

Herein, like that of the second related art, at the lower end of the double roll screen 340, a twist preventing member 350 is provided, in which when the roll screen 340 is unwound from and wound on the winding rod 330 by rotating the winding rod 330 by manipulation of the ascending/descending means 320, the roll screen 340 is wound and unwound without twist by maintaining tension downward by self weight.

In more detail, the housing 310 is configured by a horizontal plate 310*a* which is fixed to the ceiling or wall surface of the window through a fixing bracket, a cover plate 310*b* which is extending downward from the front end of the horizontal plate 310*a* to cover the roll screen 340 wound on the winding rod 330, a fixing piece 310*c* which is bent and extended upward and downward from the rear end of the horizontal plate 310*a* to fix the other end of the roll screen 340 fixed and wound on one end to the winding rod 330, and left and right fixing members of which one end is fixed to both ends of the horizontal plate 310*a* through a screw and a lower end is integrally formed with a bent piece (not illustrated) bent inward so that the ascending/descending means 320 is installable to rotate the winding rod 330 by user's manipulation by connecting one end of the winding rod 330 and the other end of the winding rod 330. In FIG. 4, the right fixing member is indicated as reference numeral 310*e*.

The ascending/descending means 320 is a conventional general well-known technique which is installed on the inner surface of the right fixing member 310*e* to rotate the winding rod 330 according to the user's manipulation. Like the second related art, the ascending/descending means 320 is configured by an ascending fixing piece 320 *a* which is fixably provided by penetrating the bent piece of the right fixing member 310*e* to the center so as to be installed in the inside of the right surface of the housing 310, an ascending rotation piece 320*b* of which one end is rotatably provided at the ascending fixing piece 320*a* and locking holes (not illustrated) are formed in a circumferential direction at regular intervals on the outer circumferential surface, and an ascending/descending driving rope 320*c* which winds the outer circumferential surface of the ascending rotation piece 320*b* to rotate the ascending rotation piece 320*b* in response to user pulling in one direction and the other direction.

The winding rod 330 is formed to have a circular section, and one end is rotatably connected to a bent piece (not illustrated) of the left fixing piece of the housing 310 through a hinge piece (not illustrated) and the other end is fixed and connected to the ascending rotation piece 320*b* of the ascending/descending means 320, and a cutting groove 330*a* for inserting and fixing one end of the roll screen 340 is cut in a longitudinal direction on the outer circumferential surface.

The roll screen 340 is woven by continuously forming a first adjustment unit 341, a second adjustment unit 342, and a third adjustment unit 343, and the first adjustment unit 341 has first translucent mesh part 341*a*, through which objects on the opposite side are visible, and first sight and light blocking part 341*b*, through which objects on the opposite side are not visible, which are woven repeatedly to alternate with each other over a predetermined range at a predetermined width and formed at the staring portion in the entire length, and one end thereof is fixed to the fixing piece 310*c*.

The third adjustment unit 343 also has third translucent mesh part 343*a*, through which objects on the opposite side are visible, and third sight and light blocking part 343*b*, through which objects on the opposite side are not visible, which are woven repeatedly to alternate with each other over a predetermined range at a predetermined width, but formed at the end portion in the entire length, and one end thereof is fixed to the cutting groove 330*a*. The first translucent mesh part 341*a* and the first sight and light blocking part 341*b* correspond to the third translucent mesh part 343*a* and the third sight and light blocking part 343*b*.

Meanwhile, the second adjustment unit 342 also has second translucent mesh part 342*a*, through which objects on the opposite side are visible, and second sight and light blocking part 342*b*, through which objects on the opposite side are not visible, which are woven repeatedly to alternate with each other over a predetermined range at a predetermined width, but formed in the middle portion between the staring portion and the end portion in the entire length and one end is continued in the first adjustment unit 341 and the other end is continued in the third adjustment unit 343.

The second translucent mesh part 342*a* correspond to the first translucent mesh part 341*a*, but the second light blocking part 342*b* is formed to have a width larger than that of the first light blocking part 341*b*.

Preferably, widths a of the first to third translucent mesh parts 341*a*, 342*a*, and 343*a* are the same as each other, each of widths b of the first and third sight and light blocking parts 341*b* and 343*b* is slightly larger (preferably 2 to 5 cm larger, more preferably 2.5 to 4 cm larger, and most preferably 3.0 cm larger) than each of the widths a of the first and third translucent mesh parts (that is, b=a+3.0). In addition, when the first sight and light blocking part 341*b* and the third translucent mesh part 343*a* are in contact with each other in the front and rear directions when the first sight and light blocking part 341*b* and the third sight and light blocking part 343*b* block the light together, the first sight and light blocking part 341*b* and the third sight and light blocking part 343*b* overlap each other by about 1.5 cm at the upper and lower sides to fully block the light.

However, it is preferred that the second light blocking part 342*b* has a width c equal to a length obtained by adding the width of the first mesh part 341*a* to twice the width of the first light blocking part 341*b* (i.e., c=a+2b), and the second light blocking part 234*b* further serves the purpose of blocking the lower portion of the window.

This will be described in detail again with reference to FIGS. 5 and 6.

In any case, the error needs not to exceed ±5% in the above relationship of the width a of the mesh part, the width b of the first light blocking part, and the width c of the second light blocking part.

For example, the width a of the mesh part may be 5 cm, the width b of the first light blocking part may be 8.0 cm, and the width c of the second light blocking part may be 21 cm.

As a result, the roll screen 340 formed at the start portion and the end portion is wound on the winding rod 330 to entirely block the light or block only the lower portion by partially or entirely blocking the outside in response to operating the ascending/descending means 320 in unwinding and winding directions as illustrated in FIGS. 4 to 6, thereby preventing the inside of the interior from being seen from the outside from the whole or middle portion to the lower portion. As a result, each of the lengths of the first adjustment unit 341 and the third adjustment unit 343 formed at the start portion and the end portion of the entire length is about ¼ of the entire length, and the lengths of the first adjustment unit 341 and the third adjustment unit 343 are the same as each other, and the second adjustment unit 342 is formed in a section of about ¾ of the entire length obtained by subtracting the length of the first adjustment unit 341 formed at the upper portion and the length of the third adjustment unit 343 formed at the lower portion from the entire length.

However, each of the lengths of the first adjustment unit 341 and the third adjustment unit 343 is not necessarily limited to about ¼ of the entire length, and each of the lengths of the first adjustment unit 341 and the third adjustment unit 343 is formed to be slightly larger or slightly smaller than ¼ of the entire length. If each of the lengths of the first adjustment unit 341 and the third adjustment unit 343 is smaller than ¼ of the entire length, a ratio of the upper portion to the entire blind height is less than ⅓ when the blind is fully deployed, which is not preferable, and if each of the lengths of the first adjustment unit 341 and the third adjustment unit 343 is larger than ⅓ of the entire length, the ratio of the upper portion to the entire blind height exceeds ⅔ when the blind is fully deployed, which is not preferable. That is, each of the lengths of the first adjustment unit 341 and the third adjustment unit 343 is preferably ⅙ or more of the entire length and ⅓ or less, and more preferably about ¼ of the entire length.

That is, most preferably, the roll screen 340 has the first adjustment unit 341 and the third adjustment unit 343 formed in an interval of about ¼ of the start and end portions with respect to the entire length, and the second adjustment unit 342 formed to have a length of about ¾ of the entire length in the middle portion.

More particularly, the roll screen 340 is configured by the first adjustment unit 341 formed at the start portion and the third adjustment unit 343 formed at the end portion with respect to the entire length direction and the second adjustment unit 342 formed between the first adjustment unit 341 and the third adjustment unit 343. The first adjustment unit 341 and the third adjustment unit 343 of the roll screen 340 formed at the start portion and the end portion are wound on the winding rod 330 to entirely block the light or block only the lower portion by partially or entirely blocking the outside in response to operating the ascending/descending means 320 in unwinding and winding directions or preventing the inside of the interior from being seen from the outside from the whole or middle portion to the lower portion. Accordingly, each of the lengths of the first adjustment unit 341 and the third adjustment unit 343 formed at the start portion and the end portion of the entire length is about ¼ of the entire length, and the lengths of the first adjustment unit 341 and the third adjustment unit 343 are the same as each other, and the second adjustment unit 342 is formed in a section of about ¾ of the entire length obtained by subtracting the length of the first adjustment unit 341 formed at the upper portion and the length of the third adjustment unit 343 formed at the lower portion from the entire length.

Meanwhile, the second adjustment unit 342 is integrally formed by weaving the first and third adjustment units by weaving as described above, but is not limited thereto, and the second adjustment unit 342 is woven to correspond to the width of the woven roll screen so that the both ends thereof are fixed to the screen in which the translucent mesh part and the sight and light blocking part are alternately woven through a fixing means or fusion or sewing.

When describing the operation of the multifunctional double roll blind having the roll screen according to the present invention, after the multifunctional double roll blind having the roll screen according to the present invention is fixed to the ceiling of the window, when the roll screen 340 of the roll blind 300 intends to be adjusted to block the light or prevent the inside of the interior from being seen from the outside and enable ventilation, as illustrated in FIG. 4 of the accompanying drawings, first, the user grips the ascending/descending driving rope 320*c* and pulls the driving rope 320*c* downward.

When the ascending/descending driving rope 320 *c* is pulled downward, the ascending rotation piece 320 *b* of the ascending/descending means 320 is rotated, and as a result, the winding rod 330 having one end and the other end rotatably mounted on the housing 310 and the ascending/descending rotation piece 320 *b* is rotated in one direction, that is, in a direction in which the roll screen 340 wound on the winding rod 330 is unwound.

The roll screen 340 is tensioned downward by the self-weight of the twist preventing member 350 in response to the rotation of the winding rod 340 and unwound without twist.

(1) As such, by using the roll screen 340 wound on the winding rod 330 while the roll screen 340 is unwound from the winding rod 330 as described above, the upper portion of the window transmits light and outer air and the user can see the outside in the interior and the lower portion is blocked not to see the outside, the user gripes the ascending/descending driving rope 320*c* and pulls the driving rope 320*c* downward so that the first translucent mesh part 341*a* and the second translucent mesh part 342*a* of the wound roll screen 340 are matched with each other and the second translucent mesh part 342*a* are matched with the second sight and light blocking part 342*b* (see FIG. 6). In this case, the first sight and light blocking part 341*b* and the third sight and light blocking part 343*b* are also matched with each other, but since the second sight and light blocking part 342*b* are formed to have a long width, the second sight and light blocking part on the front surface are matched with some of the second translucent mesh part 342*a* and the second sight and light blocking part 342*b* on the rear surface.

Accordingly, as illustrated in FIG. 6, the roll screen is deployed, and like the above example, when the width a of the mesh part is 5 cm, the width b of the first light blocking part is 8.0 cm, and the width c of the second light blocking part is 21 cm, the roll screen becomes an upper-opened and lower-blocked mode in which the upper portion is matched with the first and third translucent mesh parts and opened and the lower portion is blocked. In some cases, the winding rod may be slightly rotated to partially match the first and third translucent mesh parts with each other to be in an upper partial open mode.

(2) Meanwhile, when the winding rod 330 is further or less rotated as illustrated in FIG. 5, that is, when the first translucent mesh part 341*a* and the second translucent mesh part 342*b* are matched with each other and the first sight and light blocking part 341*b* and the second translucent mesh part 342*a* are matched with each other, the second translucent mesh parts 342*a* are still blocked by the second sight and light blocking parts 342*b* with large widths, and thus, the roll screen may be in an upper and lower blocking mode in which the upper portion of the window is blocked and the lower portion is blocked.

(3) On the other hand, in the upper and lower blocking mode, when the winding rod 330 is further or less rotated as illustrated in FIG. 4, that is, when the first translucent mesh part 341*a* and the third translucent mesh part 343*a* are matched with each other and the second translucent mesh parts 342*a* are also matched with other second translucent mesh parts 342*a*, and thus, the roll screen may be in an upper and lower open mode in which the upper portion of the window is opened and the lower portion is opened.

However, in this case, the upper portion has a structure in which 21 cm blocking is repeated, but the lower portion has a structure in which 5 cm opening and 21 cm blocking are repeated. Also, in some cases, the winding rod is slightly further rotated to partially match the first and third translucent mesh parts with each other and partially match the second translucent mesh part with each other to be in an upper and lower partial open mode.

Figure 2:
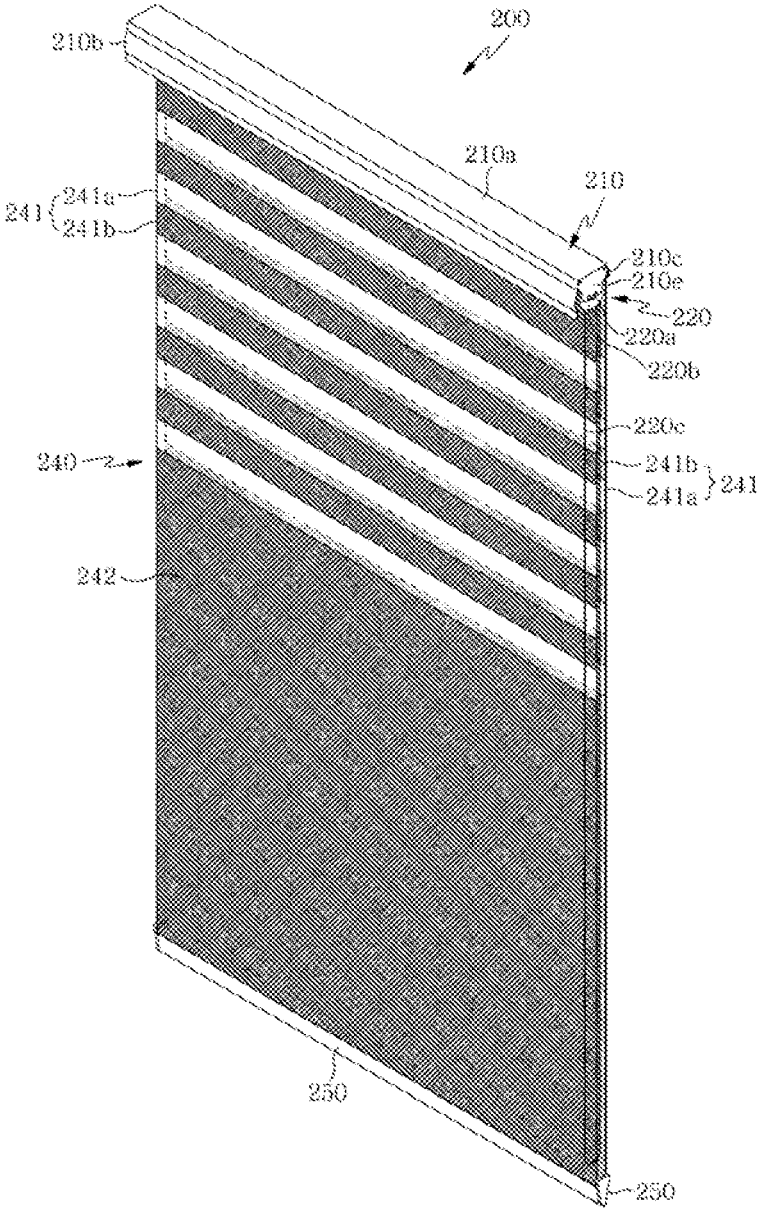
Fig. 2 (prior art)
FIG. 2 is a perspective view illustrating a use state of a multifunctional double roll blind having a roll screen according to the second related art.
Figure 3A:
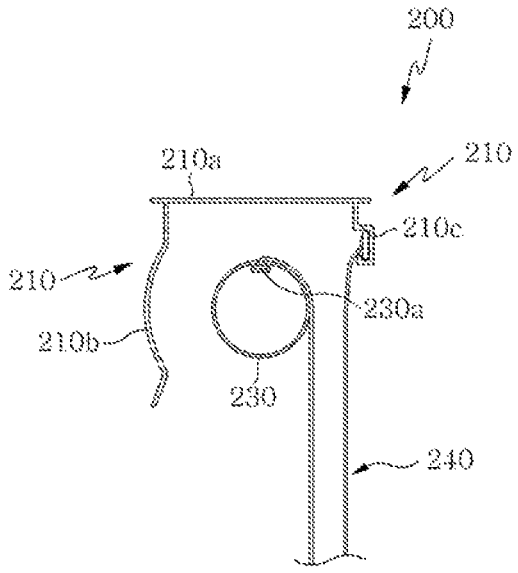
Fig. 3A (prior art)
FIG. 3A is a partially cross-sectional view illustrating drivers of the multifunctional double roll blind having a roll screen according to the second related art and FIG. 3B is a partially cross-sectional view illustrating drivers of the multifunctional double roll blind having a roll screen according to the present invention.
Figure 3B:
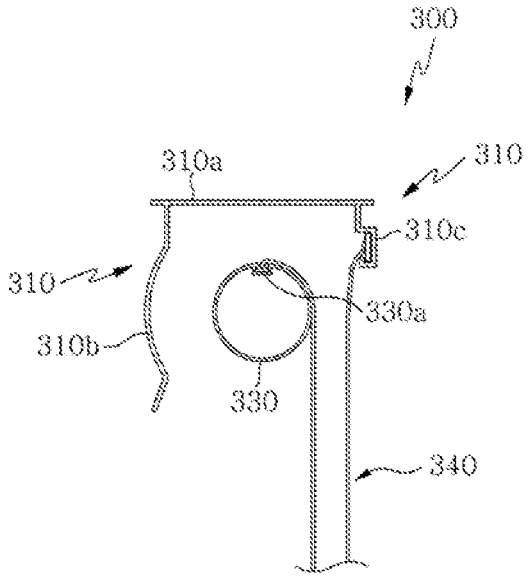

As such, while the roll screen is almost deployed, i) according to the double roll blind in the first related art, two modes in which the whole portion is opened or the whole portion is closed are enabled (that is, the whole portion can be integrally adjusted), ii) even in the double roll blind according to the second related art in FIG. 2, only two modes in which the upper portion is opened and the lower portion is closed or the whole portion is closed are enabled (that is, while the lower portion is closed, only the upper portion can be adjusted), but iii) according to the double roll blind according to the present invention, three modes in which the upper portion is opened and the lower portion is closed, the whole portion is closed, and the whole portion is opened are enabled (that is, the whole portion can be integrally adjusted, and while the lower portion is closed, only the upper portion can be adjusted).

Of course, considering the fact that in the second related art of FIG. 2, the privacy protection is almost performed in the lower portion, while only the lower portion is closed, only the upper portion may be adjusted so that it is closer to the user's need. Even in the second related art of FIG. 2, when the whole portion is opened, it is achieved by fully winding the roll blind, but in this case, there is a disadvantage in that the upper and lower portions need to be fully opened, and furthermore, there is an inconvenience that the blind needs to be driven for a long time to be fully deployed and fully wound. However, according to the present invention, if only about 6.5 cm in the maximum deployed state (in an upper-adjustment lower-closed mode) of FIG. 6 is wound, the state of FIG. 5 (a full closed mode) is enabled and when only about 6.5 cm is further wound, the state of FIG. 4 (a full control mode) is enabled.

Of course, there may be a case where the upper portion is closed and only the lower portion is opened, and in this case, the screen may be achieved only by winding and unwinding only the middle portion. Even in this case, in the second related art of FIG. 2, only the upper portion is closed, but according to the present invention, there is an additional advantage in that the upper portion may be adjusted to a partially opened state. Of course, even in the double roll blind of the first related art, while the lower portion is fully opened, the upper portion may be adjusted, but in the double roll blind of the first related art, only the lower portion is not closed at all. As a result, the present invention can achieve both advantages of the blind of the first related art and the blind of the second related art of FIG. 2.

For reference, if the full closed mode of FIG. 5 is achieved, it is necessary to wind about 6.5 cm in the fully deployed state and lift the lower end of the twist preventing member 350 having a weight by about 3.25 cm. However, since the width of the window frame is usually about 7 to 8 cm, even if the lower end of the screen ascends about 3.25 cm from the rim of the window, there is no problem in fully closing the window.

As described above, the multifunctional dual roll blind having the roll screen of the present invention can use various desired roll screens by a simple manipulation of the user with only one double roll blind, thereby satisfying the user's demands.

Meanwhile, in the first exemplary embodiment of FIGS. 4 to 6, while the roll screen is maximally deployed as illustrated in FIG. 6, the lower-closed upper-opened state is implemented, and when about 6.5 cm is wound in the full closed mode of FIG. 5 is implemented, and when about 6.5 cm is further wound, the full adjustment mode of FIG. 4 is implemented, but another second exemplary embodiment for implementing winding and unwinding of the roll screen in an opposite direction is also possible.

Figure 7:
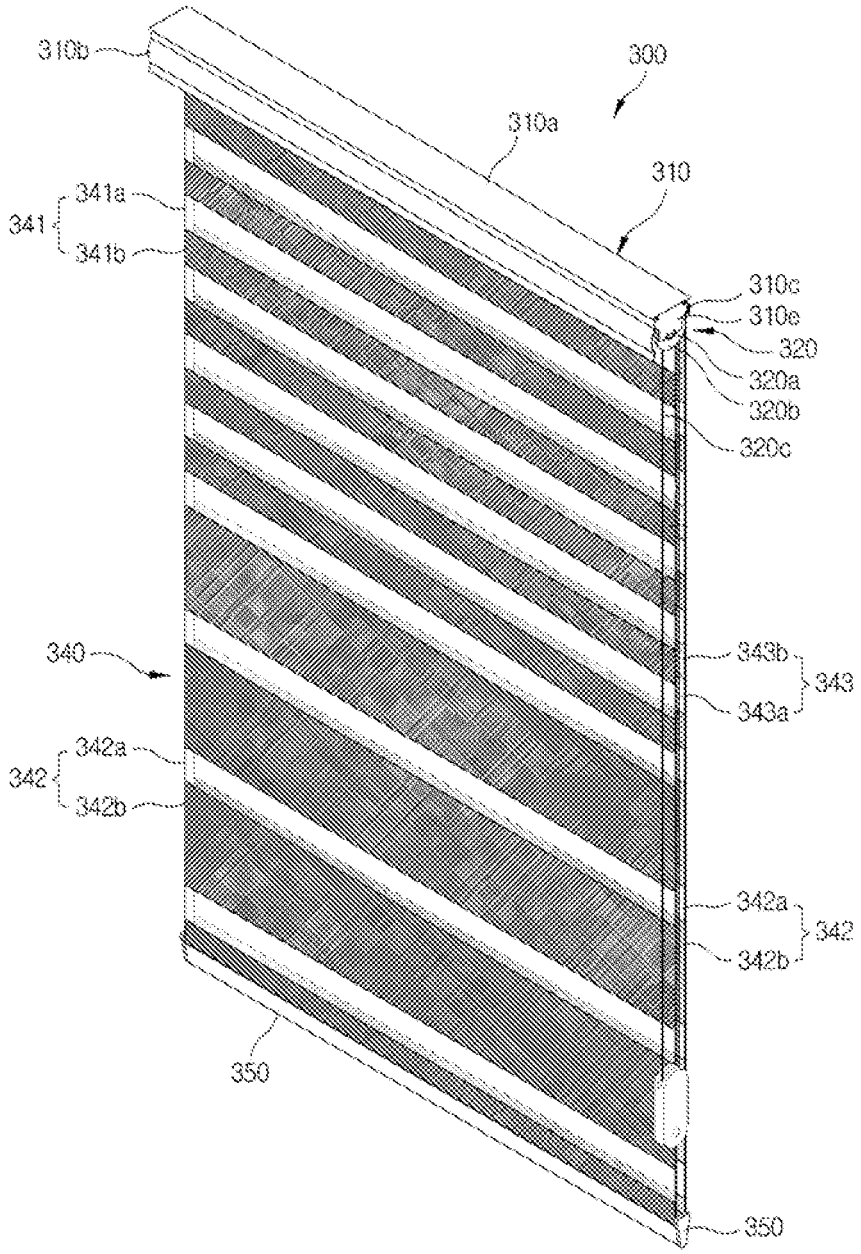
FIG. 7 is a perspective view illustrating a use state of a multifunctional double roll blind having a roll screen according to another exemplary embodiment of the present invention.
Figure 8:
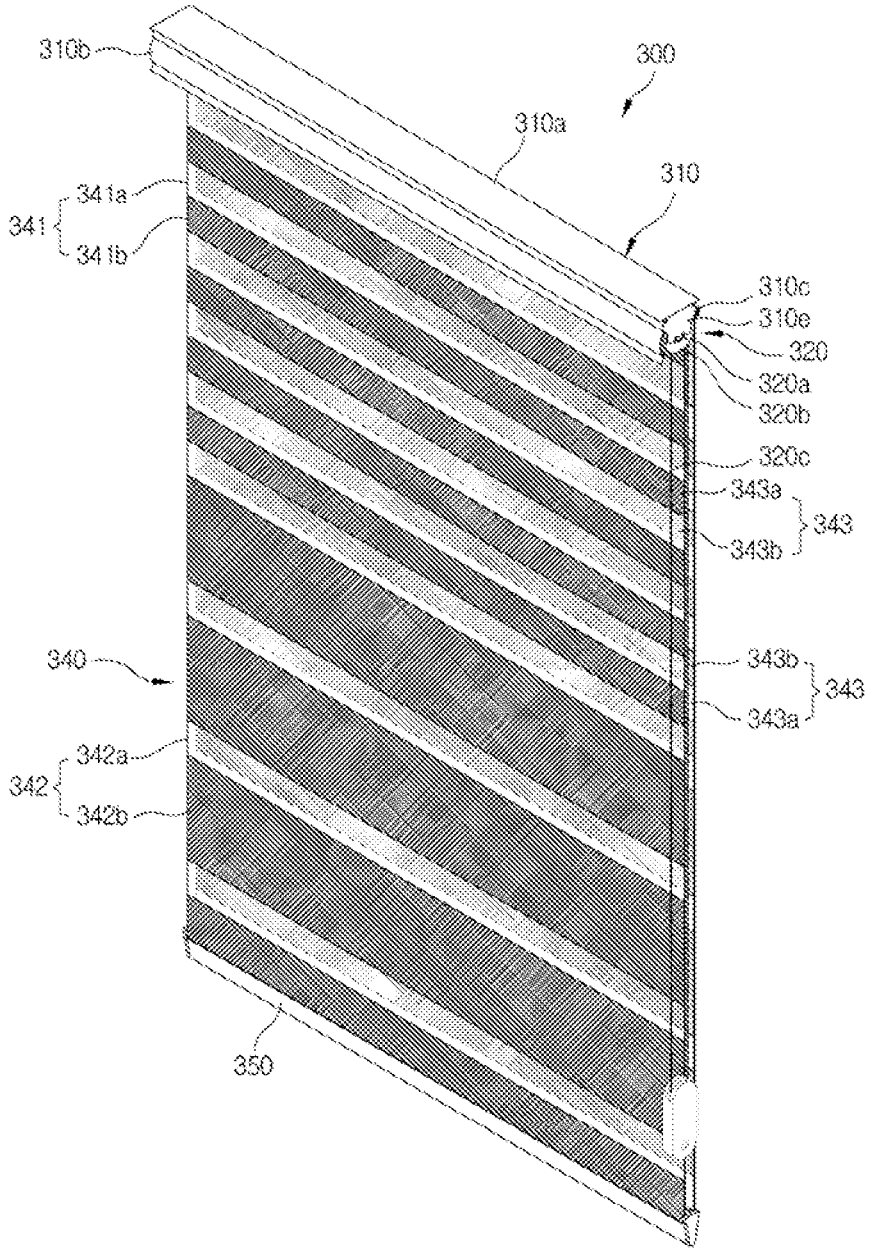
FIG. 8 is a perspective view illustrating another use state of the multifunctional double roll blind having a roll screen according to another exemplary embodiment of the present invention.
Figure 9:
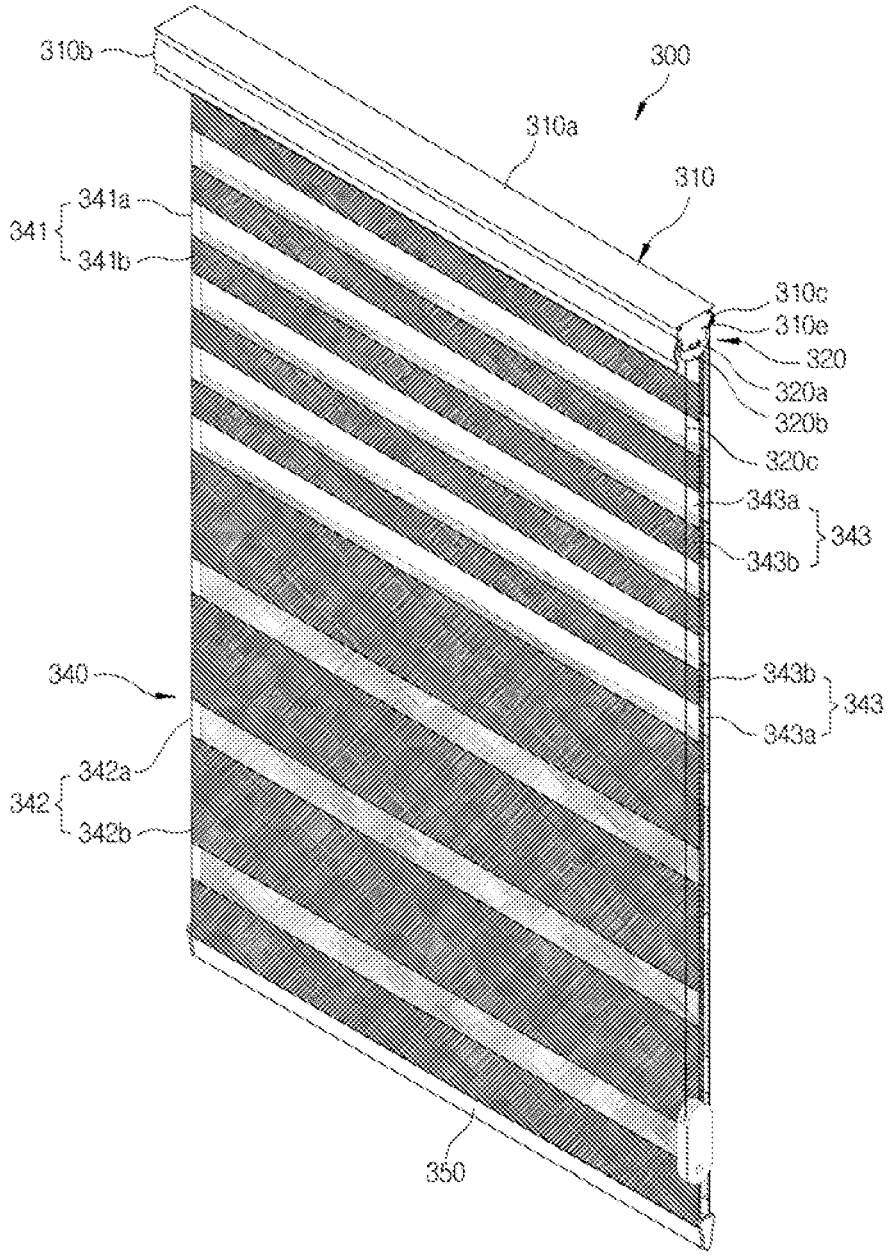
FIG. 9 is a perspective view illustrating yet another use state of the multifunctional double roll blind having a roll screen according to another exemplary embodiment of the present invention.

FIG. 7 is a perspective view illustrating a use state of a multifunctional double roll blind having a roll screen according to another exemplary embodiment of the present invention, FIG. 8 is a perspective view illustrating another use state of the multifunctional double roll blind having a roll screen according to another exemplary embodiment of the present invention, and FIG. 9 is a perspective view illustrating yet another use state of the multifunctional double roll blind having a roll screen according to another exemplary embodiment of the present invention.

In the exemplary embodiment, the full adjustment mode is implemented in a state in which the roll screen is maximally deployed as illustrated in FIG. 7, and when about 6.5 cm is wound in the maximum deployed state (a full adjustment mode) in FIG. 7, the full adjustment mode of FIG. 8 is implemented, and when about 6.5 cm is further wound, the lower-closed and upper-opened mode of FIG. 9 is implemented, and thus, the roll screen needs to be wound and unwound in the opposite direction to that of the first exemplary embodiment.

In the case of the first exemplary embodiment, it is preferable to complete sealing in that the lower portion is closed when fully deployed, whereas in the second exemplary embodiment, the screen has a symmetrical structure, and thus there is an advantage of it is preferable when cutting a long woven fabric to a required length. Hereinabove, it is described that the roll screen is woven to have the translucent mesh part and the sight and light blocking part, but the translucent mesh part are not necessarily made of a woven material having air permeability and other transparent materials do not depart from the scope of the technical spirit of the present invention. However, in the case of the material having air permeability, it is more preferable because it is possible to exhibit not only lighting and a vision but also ventilation purpose of inner and outer parts. In addition, when the translucent mesh part and the sight and light blocking part are woven integrally, it is preferred that winding and unwinding are more natural and a thin screen is enabled, but it is not necessarily limited thereto.

The aforementioned present invention is not limited to the aforementioned exemplary embodiments and the accompanying drawings, and it will be obvious to those skilled in the technical field to which the present invention pertains that various substitutions, modifications, and changes may be made within the scope without departing from the technical spirit of the present invention.

What is claimed is:

1. A multifunctional double roll blind having a roll screen (340), the blind comprising:

a housing (310);

a winding rod (330) attached to a means for ascending or descending the roll screen (340) in a vertical direction by winding or unwinding, respectively within the housing (310), wherein one end of the roll screen (340) is attached to the winding rod (330) and an opposite end of the roll screen (340) is attached to the housing (310); and a twist preventing member (350) applying a tension on the roll screen (340) for antitwisting when the winding rod (330) is rotating for winding or unwinding the roll screen (340), wherein the roll screen (340) has a front side and a rear side opposite to the front side, wherein the front side has an upper section and a lower section, and the rear side has an upper section and a lower section, wherein the roll screen (340) comprises a first adjustment unit (341) at the upper section of the front side, a third adjustment unit (343) at the upper section of the rear side, and a second adjustment unit (342) formed between the first adjustment unit (341) and the third adjustment unit (343) and at the lower section of the front side and the lower section of the rear side, the first adjustment unit (341) has a first length in the vertical direction, the third adjustment unit (343) has a third length in the vertical direction, the second adjustment unit (342) has a second length in the vertical direction, the second length of the second adjustment unit (342) is a front side length of the second adjustment unit (342) at the front side in the vertical direction combined with a rear side length of the second adjustment unit (342) at the rear side in the vertical direction, the first length of the first adjustment unit (341) is longer than one-sixth (⅙) of an entire length of the roll screen (340) and less than one-third (⅓) of the entire length of the roll screen (340), the third length of the third adjustment unit (343) is longer than one-sixth (⅙) of the entire length of the roll screen (340) and less than one-third (⅓) of the entire length of the roll screen (340), and the entire length of the roll screen (340) is a length of the front side of the roll screen (340) in the vertical direction combined with a length of the rear side of the roll screen (340) in the vertical direction, the first adjustment unit (341) consists of $1^{st}$ to $N^{th}$ translucent mesh parts (341*a*) and $1^{st}$ to $N^{th}$ blocking parts (341*b*) arranged in an alternating pattern, the third adjustment unit (343) consists of $1^{st}$ to $N^{th}$ translucent mesh parts (343*a*) and $1^{st}$ to $N^{th}$ blocking parts (343*b*) arranged in an alternating pattern, N being four (4) or more, the second adjustment unit (342) consists of second translucent mesh parts (342*a*) and second blocking parts (342*b*) arranged in an alternating pattern, the second translucent mesh parts (342*a*) of the second adjustment unit (342) include front translucent mesh parts at the lower section of the front side and rear translucent mesh parts at the lower section of the rear side, the second blocking parts (342*b*) of the second adjustment unit (342) include front blocking parts at the lower section of the front side, rear blocking parts at the lower section of the rear side, and an intermediate blocking part extending from a portion of the lower section of the front side via the twist preventing member (350) to a portion of the lower section of the rear side when the roll screen (340) is fully deployed, the number of the front blocking parts of the second blocking parts (342*b*) is two (2) or more, the number of the rear blocking parts of the second blocking parts (342*b*) is two (2) or more and is the same as the number of the front blocking parts of the second blocking parts (342*b*), each of the $1^{st}$ to $N^{th}$ translucent mesh parts (341*a*) of the first adjustment unit (341) has a first width (a) which is a length in the vertical direction, each of the $1^{st}$ to $N^{th}$ blocking parts (341*b*) of the first adjustment unit (341) has a second width (b) which is a length in the vertical direction, each of the $1^{st}$ to $N^{th}$ translucent mesh parts (343*a*) of the third adjustment unit (343) has the first width (a) in the vertical direction, each of the $1^{st}$ to $N^{th}$ blocking parts (343*b*) of the third adjustment unit (343) has the second width (b) in the vertical direction, each of the front translucent mesh parts and the rear translucent mesh parts of the second adjustment unit (342) has the first width (a) in the vertical direction, each of the front blocking parts, the rear blocking parts and the intermediate blocking part of the second adjustment unit (342) has a third width (c) in the vertical direction, the second width (b) is wider than the first width (a) by one to five centimeters, the third width (c) is equal to the first width (a) plus two times of the second width (b) (c=a+2b), wherein the roll screen (340) is configured to be in one of the following three modes of the roll screen (340) according to rotation of the winding rod (330):

(i) a fully opening mode, when the roll screen (340) is fully deployed, (1) the $1^{st}$ to $N^{th}$ translucent mesh parts (341*a*) of the first adjustment unit (341) at the front side of the roll screen (340) are aligned with the $1^{st}$ to $N^{th}$ translucent mesh parts (343*a*) of the third adjustment unit (343) at the rear side of the roll screen (340), respectively, and (2) the front translucent mesh parts of the second adjustment unit (342) at the front side are aligned with the rear translucent mesh parts of the second adjustment unit (342) at the rear side, respectively;

(ii) a fully closed mode, when the roll screen (340) is wound by a predetermined length according to rotation of the winding rod (330) from (i) the fully opening mode, (1) the $2^{nd}$ to $N^{th}$ blocking parts (341*b*) of the first adjustment unit (341) at the front side are aligned with the $1^{st}$ to $(N-1)^{th}$ translucent mesh parts (343*a*) of the third adjustment unit (343) at the rear side, respectively, and (2) the front blocking parts of the second adjustment unit (342) and a portion of the intermediate blocking part of the second adjustment unit (342) at the front side are aligned with the $N^{th}$ translucent mesh part of the third adjustment unit (343) and the rear translucent mesh parts of the second adjustment unit (342) at the rear side; and (iii) an opening mode at the upper section and a closed mode at the lower section, when the roll screen (340) is further wound by the predetermined length according to rotation of the winding rod (330) from (ii) the fully closed mode, (1) the $2^{nd}$ to $N^{th}$ translucent mesh parts of the first adjustment unit (341) at the front side of the roll screen (340) are aligned with the $1^{st}$ to $(N-1)^{th}$ translucent mesh parts of the third adjustment unit (343) at the rear side of the roll screen (340)

(2) the front blocking parts of the second adjustment unit (342) and a portion of the intermediate blocking part of the second adjustment unit (342) at the front side of the roll screen (340) are aligned with the $N^{th}$ translucent mesh part of the third adjustment unit (343) and the rear translucent mesh parts of the second adjustment unit (342) at the rear side of the roll screen (340).

2. The multifunctional double roll blind having the roll screen (340) according to claim 1, wherein the second width (b) is wider than the first width (a) by 2.5 centimeters to 4 centimeters.

3. The multifunctional double roll blind having the roll screen (340) according to claim 1, wherein the roll screen (340) is integrally formed and the first to third translucent mesh parts (341*a*, 342*a*, 343*a*) are made of an airpermeable material.

4. The multifunctional double roll blind having the roll screen (340) according to claim 1, wherein the predetermined length is longer than the first width (a) and less than the second width (b).

* * * * *